US006489759B1

(12) United States Patent
Acharya et al.

(10) Patent No.: US 6,489,759 B1
(45) Date of Patent: Dec. 3, 2002

(54) STANDBY VOLTAGE CONTROLLER AND VOLTAGE DIVIDER IN A CONFIGURATION FOR SUPPLYING VOLTAGES TO AN ELECTRONIC CIRCUIT

(75) Inventors: Pramod Acharya, München; Andreas Täuber, Unterschleissheim, both of (DE)

(73) Assignee: Infineon Technologies AG, München (DE)

( * ) Notice: Subject to any disclaimer, the term of this patent is extended or adjusted under 35 U.S.C. 154(b) by 0 days.

(21) Appl. No.: 09/716,901

(22) Filed: Nov. 20, 2000

(30) Foreign Application Priority Data

Nov. 19, 1999 (DE) ..... 199 55 775

(51) Int. Cl.[7] ..... G05F 1/12

(52) U.S. Cl. ..... 323/297; 327/540

(58) Field of Search ..... 323/297, 293, 323/299, 303; 327/530, 538, 540

(56) References Cited

U.S. PATENT DOCUMENTS 5,337,284 A * 8/1994 Cordoba et al. ..... 365/227
6,294,950 B1 * 9/2001 Lee et al. ..... 327/539
6,320,454 B1 * 11/2001 Pathak et al. ..... 327/535

* cited by examiner

*Primary Examiner*—Adolf Deneke Berhane
(74) *Attorney, Agent, or Firm*—Laurence A. Greenberg; Werner H. Stemer; Ralph E. Locher

(57) ABSTRACT

The voltage supply provides voltages to an electronic circuit requiring at least two different supply voltages. A plurality of standby supply voltages with different levels are obtained from the highest supply voltage with the aid of a voltage divider.

8 Claims, 2 Drawing Sheets

STANDBY VOLTAGE CONTROLLER AND VOLTAGE DIVIDER IN A CONFIGURATION FOR SUPPLYING VOLTAGES TO AN ELECTRONIC CIRCUIT

BACKGROUND OF THE INVENTION

FIELD OF THE INVENTION

The present invention lies in the electronics field and in the semiconductor technology field. More specifically, the invention relates to voltage supply for an electronic circuit which supplies the electronic circuit during a standby mode with at least two supply voltages (VDD1, VDD2, . . . ) having different levels. Each of the supply voltages of the electronic circuit is supplied in the active operating mode via a respective active-voltage controller that is allocated to each level, respectively.

Many electronic circuits, for instance eDRAMs (embedded DRAMs), have two operating modes, namely a standby mode and an active mode. In the standby mode, the circuit is supplied with stable voltages such that the information stored therein is maintained. In the standby mode, the sum of the currents that are consumed by the circuit should be as small as possible.

By contrast, in the active mode, in which the electronic circuit is working and performing data processing operations, the sum of the currents supplied to the circuit is relatively large, while the voltages remain substantially the same.

It is well known that an eDRAM, as an example of such an electronic circuit, must be supplied with different voltage levels both in the standby mode and in the active mode; for instance, an amplified word line voltage with a voltage value of approx. 3.5 V (+/−10%) for a read/write operation, local and global supply voltages VBLH with voltage values of 1.8 V (+/−10%) for read amplifiers (S/A), a bias voltage VPL with total voltage values of VBLH/2 (i.e. 0.9 V) for reducing loads that are generated across the eDRAM cell by the electric field, a bit line equalization voltage VBLEQ with voltage values of VBLH/2 (i.e. approx. 0.9 V) which is applied prior to a read operation, and an eDRAM substrate bias voltage VBB with voltage values of approx. −1 V for minimizing leakage currents and increasing the cell retention time. Depending on the type of eDRAM used, all these voltages are used, or only some of them, or additional voltages as well. In addition, there are even voltages over the voltage that is externally fed to the semiconductor chip in which the eDRAM is embedded, for which voltage pumps are needed, for instance in order to generate a voltage of 3.8 V from an externally applied voltage of 3.3 V.

In existing configurations, in order to satisfy the requirement of a low power consumption, separate controllers are used to generate the individual voltages in the active and standby modes. An example of this is illustrated in FIG. 3 in a schematic block diagram.

An eDRAM 2 is embedded in a silicon semiconductor chip. The eDRAM 2 is supplied with voltages by controller units 4, 5, 6, 7, 8, and it is connected to a logic unit 3. The controller units 4 to 8 are supplied via pads 9, 10 (contact terminals) with an external supply voltage CE (via the pad 9) by a voltage source 11 that delivers a voltage of approx. 3.3 V. A reference potential T is connected via the pad 10. Additional pads 18 serve for the input/output of additional signals. From the external voltages, the controller units 4 to 8 generate the desired supply voltages with values of 2.5 V (controller unit 4), 0.9 V (controller unit 5), 0.9 V (controller unit 6), 1.8 V (controller unit 7), and 3.8 V (controller unit, i.e., pump 8). In order to be able to deliver the voltage with 3.8 V, the controller unit 8 must be realized as a voltage pump.

The construction of the controller units 4, 5 is represented, by way of example in FIG. 4: each of the controller units 4 and 5 comprises an active controller 12 and a standby controller 13, which are charged with the external high voltage CE and the external low voltage T as represented in the figure. In the active mode the controller 12 works with a relatively large current $I_1$, while in the standby mode the controller 13 delivers the respective desired voltages VDD1 and VDD2 with a relatively low current $I_0$ ($I_1 >> I_0$). The voltages VDD1 and VDD2 have values of 2.5 V and 0.9 V, respectively, as represented in FIG. 3. The voltage VDD1 is therein generated from the external voltage CE, while the voltage VDD2 is generated from the low voltage T. Lastly, FIG. 5 shows the construction of such a controller 13 consisting of N and P channel MOS transistors, resistors, and a reference voltage source. This controller construction is of a conventional type and therefore requires no further explanation.

It is already clearly evident from FIGS. 3 and 4 that the outlay for the individual controller units 4 to 8 is substantial, since each controller unit comprises two controllers 12 and 13, which must be readied for active and standby modes. This requires a relatively large area on the semiconductor chip 1.

It must also be taken into account that the controllers for the standby mode, in particular, require an extremely precise design, since the current flowing in standby mode is largely determined by the closed-circuit current of the controller.

SUMMARY OF THE INVENTION

The object of the invention is to provide a voltage supply for an electronic circuit requiring at least two supply voltages with different levels, which overcomes the above-noted deficiencies and disadvantages of the prior art devices and methods of this kind, and which is of simple construction, occupies an optimally small area on a semiconductor chip, and has a very low natural-current consumption.

With the above and other objects in view there is provided, in accordance with the invention, a voltage supply configuration for an electronic circuit having an active mode and a standby mode, and requiring at least two supply voltages with mutually different levels. The supply voltages are supplied to the electronic circuit in the active operating mode via respective active-controllers each allocated a respective voltage level. There is further provided a standby voltage controller for a highest supply voltage; and a voltage divider connected in series with the standby voltage controller and configured to generate, during the standby mode of the electronic circuit, when the active-voltage controllers are switched off, the supply voltages from the highest supply voltage.

In accordance with an added feature of the invention, the voltage divider comprises a plurality of taps connected via switches to the active-voltage controllers, and the active-voltage controllers are configured to be switched off by a standby signal.

In accordance with an additional feature of the invention, the voltage divider is connected between two transistors two transistors, the control electrodes of which are controlled via a standby signal and a phase-shifted standby signal.

In accordance with another feature of the invention, the highest supply voltage is a word line voltage of the electronic circuit.

In accordance with a further feature of the invention, the standby voltage controller contains a pump circuit. In a preferred embodiment, the voltage divider is formed with a plurality of transistors.

By way of example, the electronic circuit is a DRAM embedded in a semiconductor body.

In other words, the configuration for supplying voltages during a standby mode to an electronic circuit having at least two supply voltages with different levels, in which the supply voltages of the electronic circuit are supplied in an active operating mode thereof via respective active-controllers respectively allocated to each voltage level, comprising a voltage splitter connected in series with a standby voltage controller for a highest supply voltage, wherein, during the standby mode when the active-voltage controllers are switched off, the voltage splitter generates the supply voltages from the highest supply voltage.

The taps of the voltage divider are connected via switches to the active-voltage controllers for the remaining supply voltages, which controllers can be switched off using a standby signal. The voltage divider itself is situated between two transistors, whose control electrodes can be controlled via a standby signal and a phase-shifted standby signal. The highest supply voltage is preferably the amplified word line voltage.

The invention thus differs from the prior art in essential aspects: instead of the configuration of separate voltage controllers for the individual standby supply voltages and active supply voltages, now only the active-controllers remain. The remaining supply voltages that are needed for the standby mode are acquired with the aid of a voltage divider from the standby controller with the highest supply voltage, which is preferably the amplified word line voltage. Thus, in standby mode only the standby controller for the highest supply voltage is on, while all remaining circuits are deactivated. In this way, the power consumption can be further reduced. But most importantly, substantially less space is needed on the semiconductor chip, since the otherwise standard voltage controllers for the standby mode are no longer needed and are replaced by a simple voltage divider.

Other features which are considered as characteristic for the invention are set forth in the appended claims.

Although the invention is illustrated and described herein as embodied in a configuration for supplying voltages to an electronic circuit, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

Figure 3:
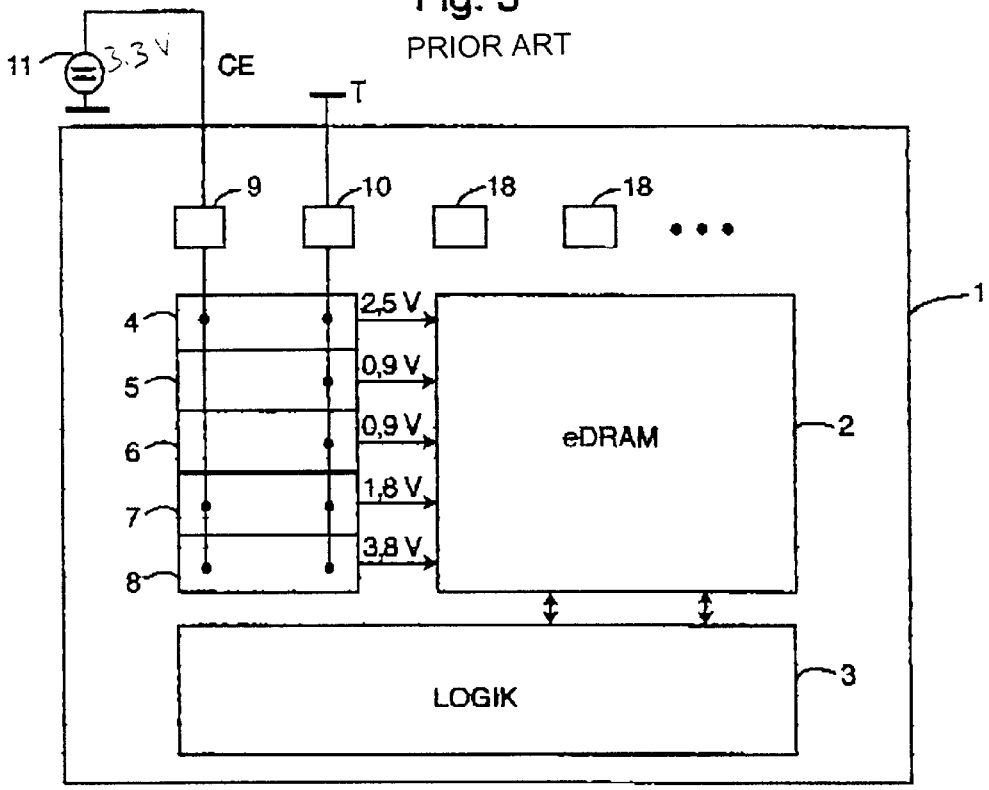
Fig. 3 PRIOR ART
FIG. 3 a block diagram of a prior art configuration.
Figure 4:
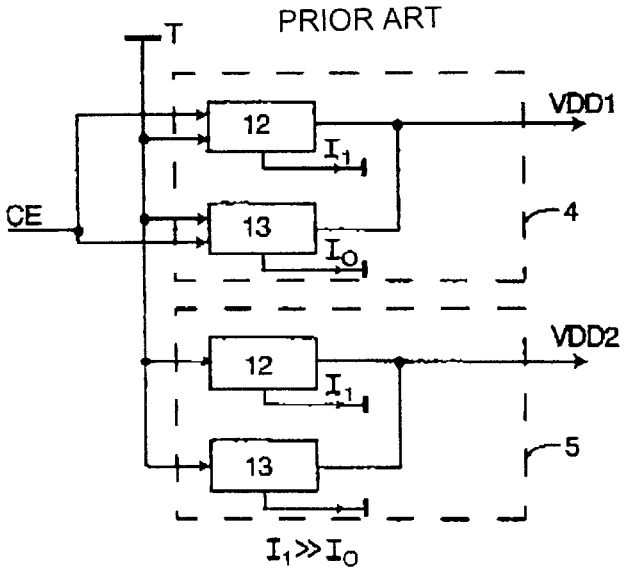
Fig. 4 PRIOR ART
FIG. 4 is a block circuit diagram illustrating the construction of controller units in the prior art configuration.
Figure 5:
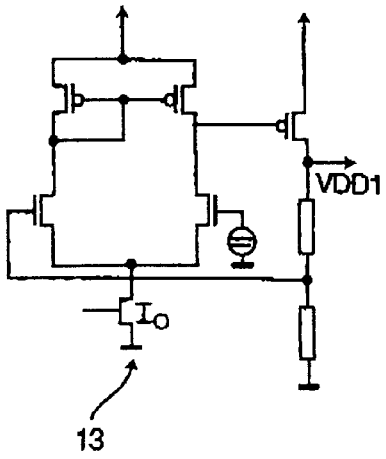
Fig. 5 PRIOR ART
FIG. 5 is a circuit diagram of a controller.

Reference is had to the description of FIGS. 3 to 5 which appears above in the introductory text.

DESCRIPTION OF THE PREFERRED EMBODIMENTS

Figure 1:
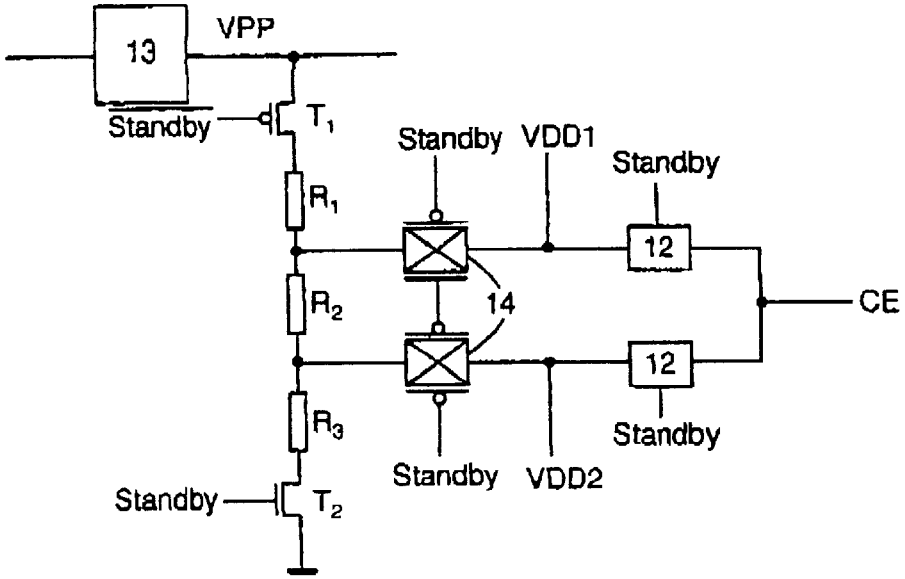
FIG. 1 is a schematic block circuit diagram of the configuration according to the invention, with two voltage taps.

Referring now to the figures of the drawing in detail and first, particularly, to FIG. 1 thereof, there is seen a circuit diagram of the inventive configuration with a controller 13, to which the highest supply voltage is fed, which is the amplified word line voltage VPP with a level of approx. 3.5 V in the example of FIG. 3. The term highest supply voltage refers to the supply voltage that is best suited to the respective purpose. It need not be the highest supply voltage in absolute terms. A voltage divider is connected in series with the controller 13. The voltage divider comprises resistors $R_1$, $R_2$ and $R_3$ and it can be activated via transistors $T_1$ and $T_2$. These transistors $T_1$ and $T_2$ can be activated and deactivated via standby signals. The voltage divider may also be composed of transistors.

The taps of the voltage divider are connected to switches 14, which are closed when a standby signal is present at same and open when there is no standby signal there. In a standby mode, the two switches 14 thus conduct. At the same time, in the standby mode the active-controllers 12 are deactivated, so that the standby supply voltages VDD1 and VDD2, which were obtained by splitting the word line voltage VPP using the voltage divider, are respectively received at the output of the switches 14. In the active mode the switches 14 are open, so that the now enabled active-voltage controllers 12 deliver the supply voltages VDD1 and VDD2 for the active mode from the external supply voltage CE.

Figure 2:
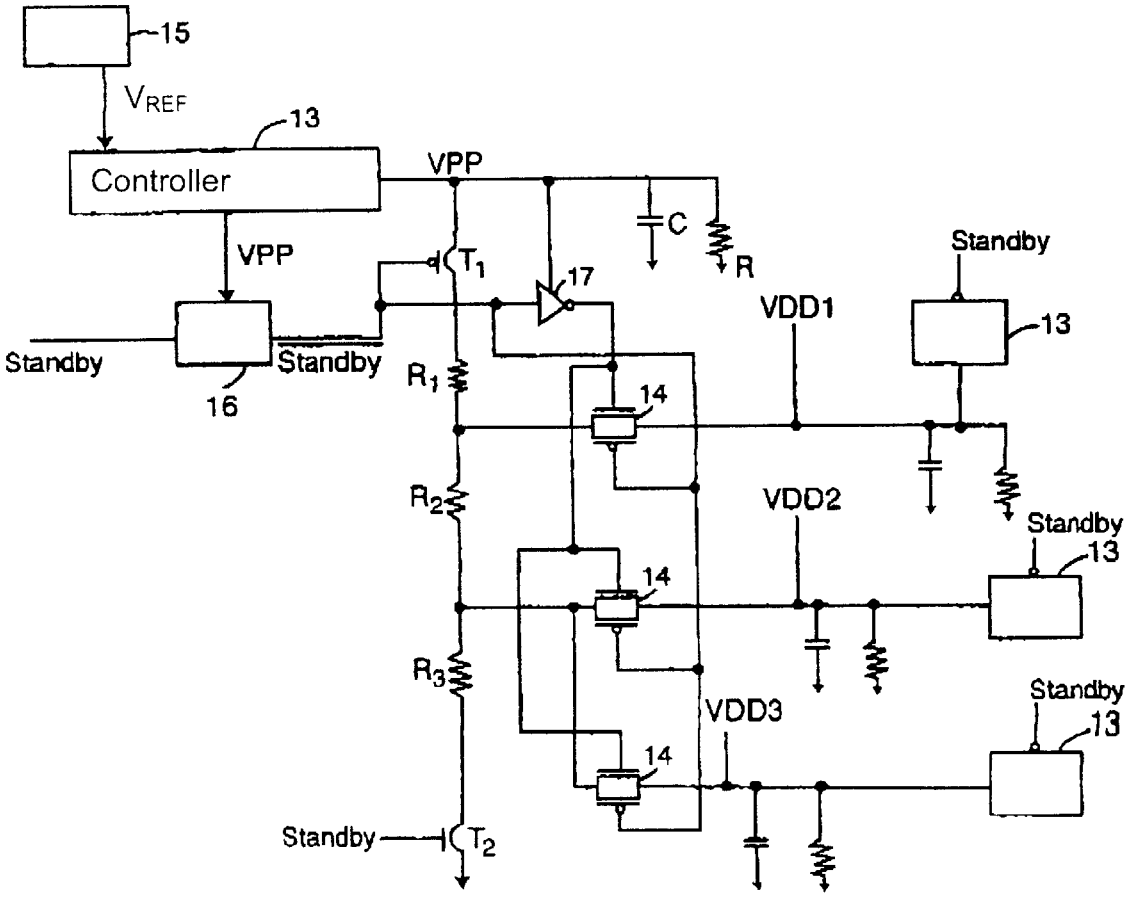
FIG. 2 is a schematic circuit diagram showing the novel configuration in greater detail, with three voltage taps therein.

FIG. 2 shows the configuration of FIG. 1 in greater detail: Here, the voltage controller 13 for standby mode, which is provided with a voltage pump, is provided with reference voltage source 15 and generates the supply voltages VPP from the reference voltage that is delivered thereby. This supply voltage VPP is fed to a level shifter 16, which is activated when a standby signal is present and is otherwise deactivated.

The transistors $T_1$ and $T_2$ that are provided at the ends of the voltage divider comprising the resistors $R_1$, $R_2$, and $R_3$ are actuated and switched on by the level-shifted standby signal, i.e. the standby signal, when the level shifter 16 delivers a level-shifted output signal given the presence of the standby signal at same.

The level-shifted output signal of the level shifter 16 and the signal that has been inverted relative thereto by an inverter 17 are present at the switches 14, whereby these switches 14 conduct when the level-shifted signal and the inverted signal are present; i.e. the standby mode is present. But in the standby mode the active-controllers 13 are switched off, so that the supply voltages VDD1, VDD2 and VDD3 that are generated by the voltage divider are delivered at the output of the switches 14.

If the standby signal is not present at the level shifter 16, the voltage divider is deactivated, and the switches 14 are open, while the active-controller 13 is on. As a result, the supply voltages VDD1, VDD2, and VDD3 for the active mode are delivered by the controllers 13.

We claim:

1. In a voltage supply configuration for an electronic circuit having an active mode and a standby mode, and requiring at least two supply voltages with mutually different levels, wherein the supply voltages are supplied to the electronic circuit in the active operating mode via respective active-controllers each allocated a respective voltage level, the improvement which comprises:

a standby voltage controller for a highest supply voltage; and a voltage divider connected in series with said standby voltage controller and configured to generate, during the standby mode of the electronic circuit, when the active-voltage controllers are switched off, the supply voltages from the highest supply voltage.

2. The configuration according to claim 1, wherein said voltage divider comprises a plurality of taps connected via switches to the active-voltage controllers, and said active-voltage controllers are configured to be switched off by a standby signal.

3. The configuration according to claim 1, which comprises two transistors configured to be controlled via a standby signal and a phase-shifted standby signal, and wherein said voltage divider is connected between said two transistors.

4. The configuration according to claim 1, wherein the highest supply voltage is a word line voltage of the electronic circuit.

5. The configuration according to claim 1, wherein said standby voltage controller contains a pump circuit.

6. The configuration according to claim 1, wherein said voltage divider is formed with a plurality of transistors.

7. The configuration according to claim 1, wherein the electronic circuit is a DRAM embedded in a semiconductor body.

8. A configuration for supplying voltages during a standby mode to an electronic circuit having at least two supply voltages with different levels, in which the supply voltages of the electronic circuit are supplied in an active operating mode thereof via respective active-controllers respectively allocated to each voltage level, comprising a voltage splitter connected in series with a standby voltage controller for a highest supply voltage, wherein, during the standby mode when the active-voltage controllers are switched off, said voltage splitter generates the supply voltages from the highest supply voltage.

* * * * *